US010975606B2

(12) United States Patent
Kashiwabara et al.

(10) Patent No.: US 10,975,606 B2
(45) Date of Patent: Apr. 13, 2021

(54) WINDOW REGULATOR

(71) Applicant: Johnan Manufacturing Inc., Nagano (JP)

(72) Inventors: Hideo Kashiwabara, Nagano (JP); Takeshi Nishizawa, Nagano (JP); Hiroki Shimizu, Nagano (JP); Yukihide Yamazaki, Nagano (JP)

(73) Assignee: JOHNAN MANUFACTURING INC., Nagano (JP)

( * ) Notice: Subject to any disclaimer, the term of this patent is extended or adjusted under 35 U.S.C. 154(b) by 85 days.

(21) Appl. No.: 16/276,000

(22) Filed: Feb. 14, 2019

(65) Prior Publication Data

US 2019/0257134 A1 Aug. 22, 2019

(30) Foreign Application Priority Data

Feb. 22, 2018 (JP) ..... JP2018-029821

(51) Int. Cl.
*E05F 15/689* (2015.01)
*E05D 15/16* (2006.01)

(52) U.S. Cl.
CPC ..... *E05F 15/689* (2015.01); *E05D 15/165* (2013.01); *E05Y 2900/55* (2013.01)

(58) Field of Classification Search
CPC ..... E05F 11/486; E05F 11/488; E05F 11/485; E05F 11/382; E05F 11/483; E05F 15/689;
(Continued)

(56) References Cited

U.S. PATENT DOCUMENTS 4,442,632 A * 4/1984 Greco ..... E05F 11/382 49/352
5,740,630 A * 4/1998 Medebach ..... E05F 11/485 49/352

(Continued)

FOREIGN PATENT DOCUMENTS

CN 103069094 A 4/2013
CN 103210166 A 7/2013

(Continued)

OTHER PUBLICATIONS

Office Action issued in the corresponding JP Patent Application No. 2018-029821 dated Feb. 25, 2020.

(Continued)

*Primary Examiner* — Justin B Rephann
(74) *Attorney, Agent, or Firm* — Roberts Calderon Safran & Cole P.C.

(57) ABSTRACT

A window regulator includes a guide rail provided along an ascending/descending direction of a window of a vehicle, a carrier plate that slides on the guide rail and moves together with the window, and an ascending-side cable that pulls the carrier plate in the ascending direction and a descending-side cable that pulls the carrier plate in the descending direction. The carrier plate includes an ascending-side spring housing hole, a descending-side spring housing hole and a holding hole, the ascending-side spring housing hole housing an end of the ascending-side cable and an ascending-side spring, the descending-side spring housing hole housing an end of the descending-side cable and a descending-side spring. The holding hole and the descending-side spring housing hole are aligned in a vertical direction. A portion of the holding hole overlaps the descending-side spring housing hole in a vehicle longitudinal direction.

4 Claims, 4 Drawing Sheets

(58) Field of Classification Search
CPC ..... E05Y 2900/55; E05Y 2201/224; E05Y 2201/64
See application file for complete search history.

(56) References Cited

U.S. PATENT DOCUMENTS

| | | | | |
|---|---|---|---|---|
| 5,950,365 | A * | 9/1999 | Lieb | B60J 1/17 49/28 |
| 7,765,739 | B2 * | 8/2010 | Munezane | E05F 11/483 49/352 |
| 8,720,114 | B2 | 5/2014 | Matsushita | |
| 9,163,448 | B2 * | 10/2015 | Imaoka | E05F 15/689 |
| 9,790,728 | B2 | 10/2017 | Arimoto et al. | |
| 10,604,981 | B2 * | 3/2020 | Shiroma | E05F 11/486 |
| 2004/0134130 | A1 * | 7/2004 | Dobson | E05F 11/488 49/352 |
| 2004/0154227 | A1 * | 8/2004 | Yoshimura | E05F 11/385 49/352 |
| 2007/0180773 | A1 * | 8/2007 | Fortin | E05F 15/689 49/352 |
| 2008/0236049 | A1 | 10/2008 | Arimoto | |
| 2010/0223852 | A1 * | 9/2010 | Arimoto | E05F 11/385 49/352 |
| 2012/0117883 | A1 | 5/2012 | Matsushita | |
| 2013/0219794 | A1 | 8/2013 | Nakamura et al. | |
| 2014/0007507 | A1 * | 1/2014 | Umemura | E05F 11/486 49/349 |
| 2017/0370145 | A1 * | 12/2017 | Koike | B60J 1/17 |
| 2019/0169900 | A1 * | 6/2019 | Arimoto | E05F 11/485 |

FOREIGN PATENT DOCUMENTS

| | | | |
|---|---|---|---|
| JP | 2011-26858 | A | 2/2011 |
| JP | 2011-89311 | A | 5/2011 |
| JP | 2012-57376 | A | 3/2012 |
| JP | 2013-207082 | A | 10/2013 |
| JP | 2015-121059 | A | 7/2015 |
| JP | 5823391 | A | 11/2015 |

OTHER PUBLICATIONS

Office Action issued in the corresponding Chinese Patent Application No. 201910129272.4 dated May 20, 2020.

Third Party Submission filed on May 27, 2020 in the corresponding Japanese Patent Application No. 2018-029821 (received by JPO Notice dated Jun. 30, 2020).

Office Action issued in the corresponding Chinese Patent Application No. 201910129272.4 on Jan. 14, 2021.

* cited by examiner

WINDOW REGULATOR

CROSS-REFERENCE TO RELATED APPLICATIONS

The present application is based on Japanese patent application No. 2018-029821 filed on Feb. 22, 2018, the entire contents of which are incorporated herein by reference.

BACKGROUND OF THE INVENTION

1. Field of the Invention

The invention relates to a window regulator.

2. Description of the Related Art

A window regulator is known which is provided with a guide rail provided along an ascending/descending direction of a window, a carrier plate sliding on and guided by the guide rail, wires for pulling the carrier plate, and a housing provided at a lower end of the guide rail to hold a motor and a drum (see, e.g., JP 2011/26858 A).

SUMMARY OF THE INVENTION

In recent years, with reduction in thickness and weight of vehicle door, a housing space provided in door panel to house a window regulator has become narrower. Thus, there is a demand for a small and light window regulator.

It is an object of the invention to provide a window regulator that can be reduced in size.

According to an embodiment of the invention, a window regulator comprises:

a guide rail provided along an ascending/descending direction of a window of a vehicle;

a carrier plate that slides on the guide rail and moves together with the window; and an ascending-side cable that pulls the carrier plate in the ascending direction and a descending-side cable that pulls the carrier plate in the descending direction, wherein the carrier plate comprises an ascending-side spring housing hole, a descending-side spring housing hole and a holding hole, the ascending-side spring housing hole housing an end of the ascending-side cable and an ascending-side spring provided to apply a tensile force to the ascending-side cable, the descending-side spring housing hole housing an end of the descending-side cable and a descending-side spring provided to apply a tensile force to the descending-side cable, and the holding hole being used for holding the window, wherein the holding hole and the descending-side spring housing hole are aligned in a vertical direction, and wherein a portion of the holding hole overlaps the descending-side spring housing hole in a vehicle longitudinal direction.

Effects of the Invention

According to an embodiment of the invention, a window regulator can be provided that can be reduced in size.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Summary of the Embodiment

Figure 1:
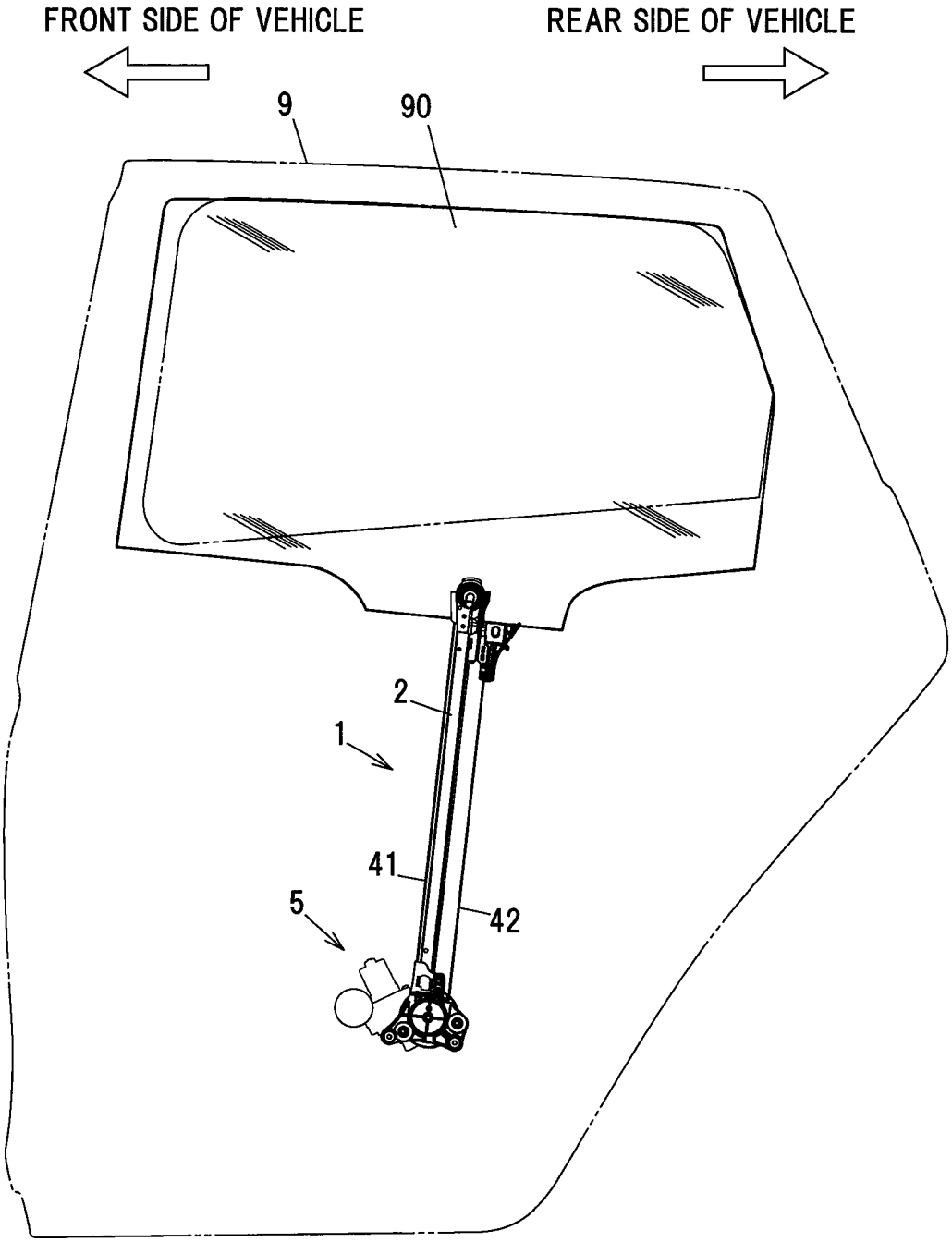
FIG. 1 is a general schematic diagram illustrating a window regulator in an embodiment and a vehicle door mounting the window regulator.

A window regulator 1 in the present embodiment is provided with a guide rail 2 provided along an ascending/descending direction of a window 90 of a vehicle, a carrier plate 3 that slides on the guide rail 2 and moves together with the window 90, an ascending-side cable 41 for pulling the carrier plate 3 in the ascending direction and a descending-side cable 42 for pulling the carrier plate 3 in the descending direction, wherein the carrier plate 3 comprises an ascending-side spring housing hole 31, a descending-side spring housing hole 32 and a holding hole 3*a*, the ascending-side spring housing hole 31 housing an end of the ascending-side cable 41 and an ascending-side spring 61 provided to apply a tensile force to the ascending-side cable 41, the descending-side spring housing hole 32 housing an end of the descending-side cable 42 and a descending-side spring 62 provided to apply a tensile force to the descending-side cable 42, and the holding hole 3*a* being used for holding the window 90, the holding hole 3*a* and the descending-side spring housing hole 32 are aligned in a vertical direction, and a portion of the holding hole 3*a* overlaps the descending-side spring housing hole 32 in a vehicle longitudinal direction.

The carrier plate 3 of the window regulator 1 can have a smaller size in the vehicle longitudinal direction than a carrier plate of a window regulator configured that a portion of a holding hole used for holding a window does not overlap a descending-side spring housing hole in the vehicle longitudinal direction.

Embodiment

The window regulator in the present embodiment is a device for raising and lowering a window on, e.g., an automobile door and is installed on a door panel of an automobile.

General Configuration of the Window Regulator 1

Figure 2:
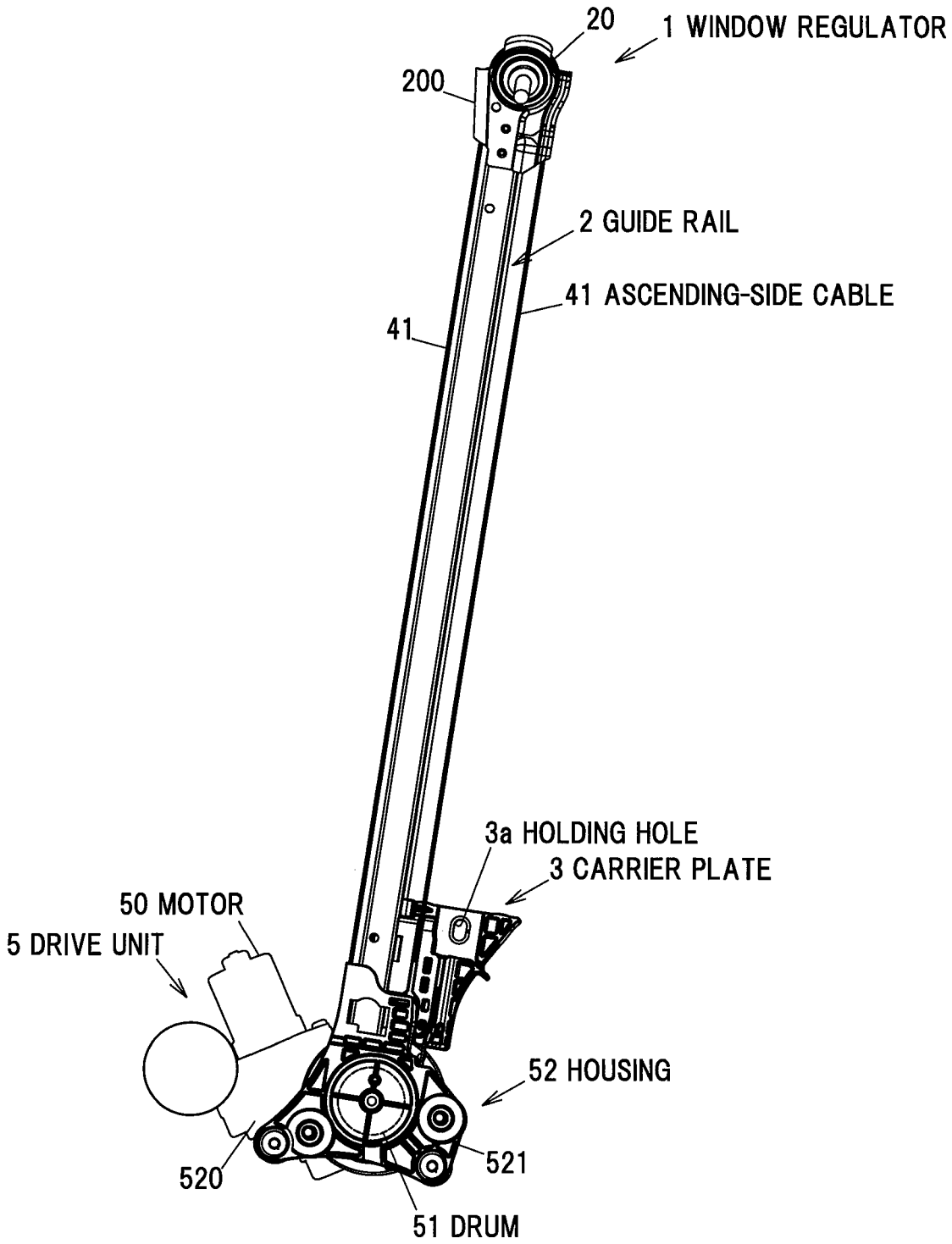
FIG. 2 is a front view showing a configuration of the window regulator of the embodiment.
Figure 3A:
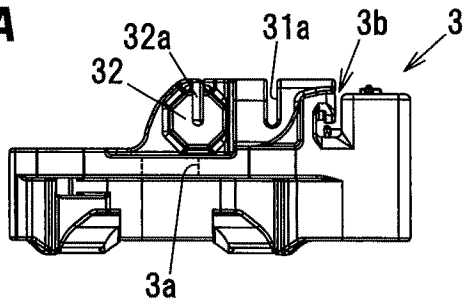
FIGS. 3A to 3E are plan views showing a configuration of a carrier plate.
Figure 3B:
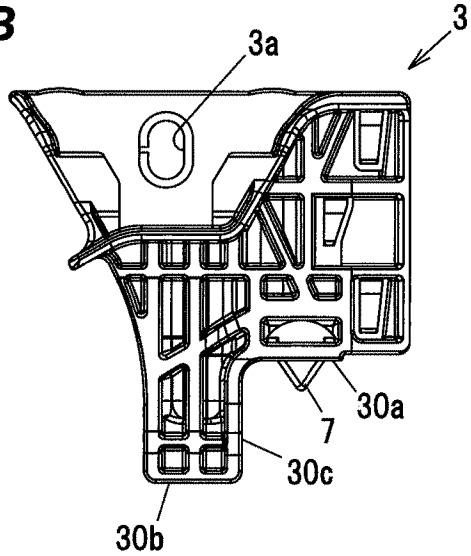
Figure 3C:
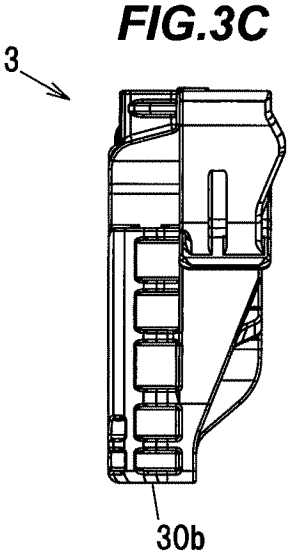
Figure 3D:
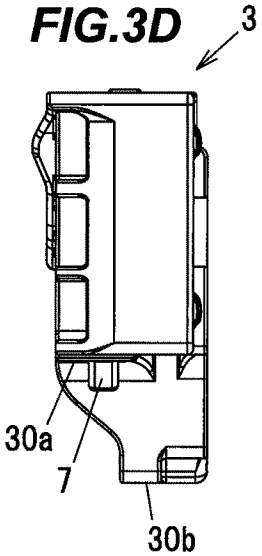
Figure 3E:
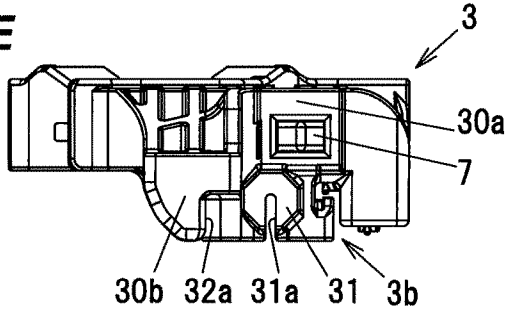
Figure 4:
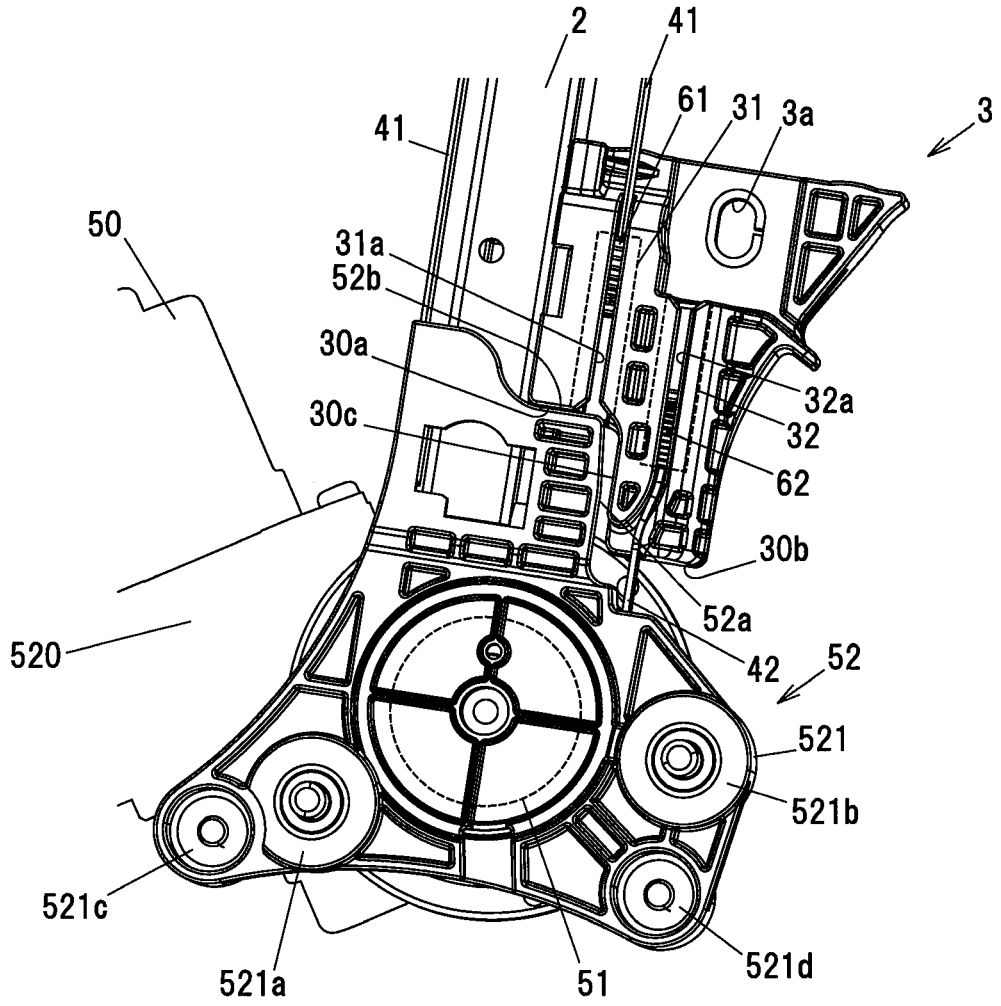
FIG. 4 is an explanatory diagram illustrating the configuration of the carrier plate and a housing.

FIG. 1 is a general schematic diagram illustrating the window regulator 1 in the present embodiment and a door 9 of a vehicle mounting the window regulator 1. FIG. 2 is an overall view showing a configuration of the window regulator 1. FIGS. 3A to 3E are plan views showing a configuration of the carrier plate, wherein FIG. 3A is a top view, FIG. 3B is a front view, FIG. 3C is a left side view, FIG. 3D is a right side view, and FIG. 3E is a bottom view. FIG. 4 is an explanatory diagram illustrating the configuration of the carrier plate and the housing.

In FIG. 1, the window 90 is in a fully-closed state, and the door and a window frame are indicated by dash-dot-dot lines. In addition, in FIG. 1, the left side of the paper is the front side in the vehicle longitudinal direction and the right side of the paper is the rear side in the vehicle longitudinal direction.

As shown in FIGS. 1 and 2, the window regulator 1 is generally composed of the guide rail 2 which is housed in a door panel (not shown) provided on the door 9 of the vehicle and is arranged along the ascending/descending direction of the window 90, the carrier plate 3 which slides on the guide rail 2 and moves together with the window 90, the ascending-side cable 41 and the descending-side cable 42 which pull the carrier plate 3, and a drive unit 5 which generates a driving force for taking up and feeding out the ascending-side cable 41 and the descending-side cable 42. In the following description, the vertical direction is a direction that the carrier plate 3 travels on the guide rail 2, the upward direction is a direction that the carrier plate 3 moves toward the upper end of the guide rail 2, and the downward direction is a direction that the carrier plate 3 moves toward the lower end of the guide rail 2.

Configuration of the Guide Rail 2

The guide rail 2 is formed by bending a long metal plate at a predetermined curvature and is arranged so as to tilt to the rear side in the vehicle longitudinal direction with respect to the door 9.

Configuration of the Carrier Plate 3

The carrier plate 3 is a plate-shaped member formed of, e.g., a resin such as polyacetal. As shown in FIGS. 3A, 3E and 4, the carrier plate 3 has the ascending-side spring housing hole 31 (indicated by a dash-dot-dot line in FIG. 4) and the descending-side spring housing hole 32 (indicated by a dash-dot-dot line in FIG. 4). The ascending-side spring housing hole 31 houses an end of the ascending-side cable 41 and the ascending-side spring 61 applying a tensile force to the ascending-side cable 41. The descending-side spring housing hole 32 houses an end of the descending-side cable 42 and the descending-side spring 62 applying a tensile force to the descending-side cable 42.

The holding hole 3*a* used for holding the window 90 is formed on the carrier plate 3. The holding hole 3*a* is a hole penetrating the carrier plate 3 in a plate thickness direction, and a glass holder (not shown) holding the window 90 is fitted to the holding hole 3*a* and fastened by a fixing member such as bolt.

Configuration of the Ascending-Side Cable 41 and the Descending-Side Cable 42

The ascending-side cable 41 is coupled to the carrier plate 3 at one end, turns at a pulley 20 provided at the top end of the guide rail 2, and is coupled to a drum 51 of the drive unit 5 (described later) at the other end. The descending-side cable 42 is coupled to the carrier plate 3 at one end and is coupled to the drum 51 at the other end. The pulley 20 is shaft-supported by a pulley bracket 200 which is fixed to the top end of the guide rail 2. The pulley bracket 200 is fixed to a door panel (not shown).

The ascending-side cable 41 and the descending-side cable 42 are routed so as not to overlap the guide rail 2 when viewed in a direction along a rotational axis of the drum 51.

Configuration of the Drive Unit 5

The drive unit 5 has a motor 50 with reducer, the cylindrical drum 51 (indicated by a dashed line in FIG. 2) and a housing 52. The drum 51 is rotationally driven by the motor 50 and rotates to take up and feed out the ascending-side cable 41 and the descending-side cable 42. The housing 52 is provided at a lower end of the guide rail 2, and is composed of a motor housing 520 accommodating a portion of the motor 50 and holding the motor 50, and a drum housing 521 accommodating the drum 51.

The motor 50 is held by the motor housing 520 and is inclined by a predetermined angle about the rotational axis of the drum 51. The reducer constructed from a worm wheel, etc., is coupled to and meshes with the output shaft of the motor 50. The reducer is housed in the motor housing 520.

The motor housing 520 and the drum housing 521 are fixed to each other by fixing portions 521*c* and 521*d*. Panel fixing portions 521*a* and 521*b* for fixing the housing 52 to the door panel are provided on the drum housing 521.

Details of the Carrier Plate 3

Next, the details of the carrier plate 3 will be described in reference to FIGS. 3 and 4.

As shown in FIG. 3E, the ascending-side spring housing hole 31 is formed in a bottomed cylindrical shape opening upward and has a bottom surface which can be seen from the outside through the opening. One end of the ascending-side spring 61 is in contact with the bottom surface of the ascending-side spring housing hole 31. The ascending-side spring housing hole 31 also has a slit 31*a* (shown in FIG. 4) which extends in the vertical direction. The slit 31*a* is formed as an insertion hole used when inserting the ascending-side cable 41 into the ascending-side spring housing hole 31. An exit hole 31*a* through which the ascending-side cable 41 extends out is formed on the bottom surface of the ascending-side spring housing hole 31.

As shown in FIG. 3A, the descending-side spring housing hole 32 is formed in a bottomed cylindrical shape opening downward and has a bottom surface which can be seen from the outside through the opening. One end of the descending-side spring 62 is in contact with the bottom surface of the descending-side spring housing hole 32. The descending-side spring housing hole 32 also has a slit 32*a* (shown in FIG. 4) which extends in the vertical direction. The slit 32*a* is formed as an insertion hole used when inserting the descending-side cable 42 into the descending-side spring housing hole 32. An exit hole 32*a* through which the descending-side cable 42 extends out is formed on the bottom surface of the descending-side spring housing hole 32.

As shown in FIGS. 3 and 4, the bottom surface of the carrier plate 3 includes a stopper surface 30*a* and an exit surface 30*b*. The stopper surface 30*a* is a surface which comes into contact with the housing 52 at a position where the carrier plate is located when the window 90 is fully opened (hereinafter, this position of the carrier plate 3 is referred to as "the bottom dead center"). The exit surface 30*b* is a surface through which the descending-side cable 42 extends out of the descending-side spring housing hole 32. The exit surface 30*b* is located at a lower position than the stopper surface 30*a*. In this configuration, a space for forming the holding hole 3*a* can be provided on the upper side of the descending-side spring housing hole 32 in the vertical direction, and the size of the carrier plate 3 in the vehicle longitudinal direction thereby can be reduced. That is, it is possible to reduce the size of the window regulator 1.

In the present embodiment, the ascending-side spring housing hole 31 and the descending-side spring housing hole 32 are out of alignment in the vertical direction in such a manner that the descending-side spring housing hole 32 is located at a lower position than the ascending-side spring housing hole 31.

As shown in FIG. 3B, an elastic body 7 having an inverted triangle-shaped end portion is provided on the stopper surface 30*a* of the carrier plate 3. The elastic body 7 is arranged so that the end portion thereof protrudes from the stopper surface 30*a*. Thus, an impact upon contact of the carrier plate 3 with the housing 52 is cushioned.

When the carrier plate 3 moves down on the guide rail 2 to fully open the window 90 and reaches the bottom dead center, the stopper surface 30*a* of the carrier plate 3 comes into contact with the housing 52 which then receives the weight of the window 90, and at the same time, a rotational moment about a contact point between the stopper surface 30*a* and the housing 52 acts on the carrier plate 3.

In more detail, a step surface 30*c* of the carrier plate 3 is not in contact with a side surface 52*a* of the housing 52 until just before the carrier plate 3 reaches the bottom dead center, and the stopper surface 30*a* of the carrier plate 3 comes into contact with an upper surface 52*b* of the housing 52 at the moment when the carrier plate 3 reaches the bottom dead center. Then, the rotational moment is generated due to the contact between the stopper surface 30*a* of the carrier plate 3 and the upper surface 52*b* of the housing 52 and acts on the carrier plate 3, and the step surface 30*c* of the carrier plate 3 then comes into contact with the side surface 52*a* of the housing 52. Thus, wobbling of the carrier plate 3 caused by the rotational moment acting on the carrier plate 3 is prevented at the time when the carrier plate 3 reaches the bottom dead center. That is, the side surface 52*a* of the housing 52 serves as a prevention surface which prevents wobbling caused by tilt of the carrier plate 3 at the bottom dead center of the carrier plate 3, and the step surface 30*c* of the carrier plate 3 serves as a contact surface which comes into contact with the prevention surface.

As shown in FIGS. 3A and 3E, a fitting groove 3*b* to which the guide rail 2 is fitted is formed on the carrier plate 3. When the carrier plate 3 moves on the guide rail 2, the carrier plate 3 slides on the side end portion of the guide rail 2 in the state that the guide rail 2 is fitted to the fitting groove 3*b*.

As shown in FIGS. 3A and 4, the carrier plate 3 is configured that the holding hole 3*a* (indicated by a dashed line in FIG. 3A) and the descending-side spring housing hole 32 are aligned in the vertical direction and a portion of the holding hole 3*a* overlaps the descending-side spring housing hole 32 in the vehicle longitudinal direction. As a result, a space for providing the holding hole 3*a* can be smaller than when the holding hole 3*a* and the descending-side spring housing hole 32 are not aligned in the vertical direction and do not overlap in the vehicle longitudinal direction, and the size of the carrier plate 3 in the vehicle longitudinal direction thereby can be reduced. That is, it is possible to reduce the size of the window regulator 1.

Furthermore, by having such configuration, it is possible to arrange the holding hole 3*a* of the carrier plate 3 closer to the guide rail 2. As a result, it is possible to reduce the moment acting when the carrier plate 3 is raised from, e.g., its bottom dead center. In detail, the farther the position of the holding hole from the guide rail 2 in the vehicle longitudinal direction, the larger the distance of the holding hole 3*a* from the fitting groove 3*b* with which the carrier plate 3 grips the guide rail 2, causing an increase in the rotational moment about the fitting groove 3*b*. However, in the present embodiment, it is possible to prevent such increase in the rotational moment. Thus, it is possible to stabilize the behavior of the window 90 during when the carrier plate 3 is raised.

In the present embodiment, the holding hole 3*a* used for holding the window 90 is provided only one in number. By having such configuration, it is possible to reduce the numbers of components and assembling processes as compared to when, e.g., plural holding holes are provided.

Although the embodiment of the invention has been described, the invention according to claims is not to be limited to the embodiment. Further, please note that all combinations of the features described in the embodiment are not necessary to solve the problem of the invention. The invention can be appropriately modified and implemented without departing from the gist thereof.

What is claimed is:

1. A window regulator, comprising:

a guide rail provided along both an ascending and a descending direction of a window of a vehicle;

a carrier plate that slides on the guide rail and moves together with the window; and an ascending-side cable that pulls the carrier plate in the ascending direction and a descending-side cable that pulls the carrier plate in the descending direction, wherein the carrier plate comprises an ascending-side spring housing hole, a descending-side spring housing hole and a holding hole, the ascending-side spring housing hole housing an end of the ascending-side cable and an ascending-side spring provided to apply a tensile force to the ascending-side cable, the descending-side spring housing hole housing an end of the descending-side cable and a descending-side spring provided to apply a tensile force to the descending-side cable and being aligned in a different position from the ascending-side spring housing hole in a vehicle longitudinal direction, and the holding hole being used for holding the window, wherein the holding hole and the descending-side spring housing hole are aligned in the vertical direction, and wherein a portion of the holding hole overlaps the descending-side spring housing hole in the vehicle longitudinal direction.

2. The window regulator according to claim 1, further comprising:

a motor;

a drum rotationally driven by the motor; and a housing that holds the motor and the drum, wherein a bottom surface of the carrier plate comprises a stopper surface and an exit surface, the stopper surface coming into contact with the housing at a position where the carrier plate is located when the window is fully opened, and the exit surface being defined as a surface through which the descending-side cable extends out of the descending-side spring housing hole, and wherein the exit surface is located at a lower position than the stopper surface.

3. The window regulator according to claim 2, wherein the holding hole provided is only one in number.

4. A window regulator comprising:

a guide rail provided along both an ascending and a descending direction of a window of a vehicle;

a carrier plate that slides on the guide rail and moves together with the window;

an ascending-side cable that pulls the carrier plate in the ascending direction and a descending-side cable that pulls the carrier plate in the descending direction;

a motor;

a drum rotationally driven by the motor; and a housing that holds the motor and the drum, wherein the carrier plate comprises an ascending-side spring housing hole and a descending-side spring housing hole, the ascending-side spring housing hole housing an end of the ascending-side cable and an ascending-side spring provided to apply a tensile force to the ascending-side cable, and the descending-side spring housing hole housing an end of the descending-side cable and a descending-side spring provided to apply a tensile force to the descending-side cable and being aligned in a different position from the ascending-side spring housing hole in a vehicle longitudinal direction, wherein a bottom surface of the carrier plate comprises a stopper surface and an exit surface, the stopper surface coming into contact with the housing at a position where the carrier plate is located when the window is fully opened, and the exit surface being defined as a surface through which the descending-side cable extends out of the descending-side spring housing hole, and wherein the exit surface is located at a lower position than the stopper surface.

* * * * *